US005933926A

United States Patent [19]

Reiter

[11] Patent Number: 5,933,926

[45] **Date of Patent: *Aug. 10, 1999**

[54] MAGNETIC SNAP FASTENERS

[76] Inventor: Howard J. Reiter, P.O. Box 3013, Milford, Conn. 06460-0813

[ * ] Notice: This patent is subject to a terminal disclaimer.

[21] Appl. No.: 09/013,629

[22] Filed: Jan. 26, 1998

Related U.S. Application Data

[63] Continuation of application No. 08/651,522, May 22, 1996, Pat. No. 5,722,126.

[51] Int. Cl.[6] ..... A44B 21/00

[52] U.S. Cl. ..... 24/303

[58] Field of Search ..... 24/303, 66.1, 683, 24/684, 689, 691, 114.2; 248/206.5; 335/285; 292/251.5; 411/501–503

[56] References Cited

U.S. PATENT DOCUMENTS

| | | | |
|---|---|---|---|
| D. 247,468 | 3/1978 | Morita . | |
| 338,269 | 3/1886 | Hovey | 24/114.2 |
| 1,782,165 | 11/1930 | Ford | 24/691 |
| 4,736,494 | 4/1988 | Marchesi | 24/691 X |
| 5,572,773 | 11/1996 | Bauer | 24/303 |
| 5,722,126 | 3/1998 | Reiter | 24/303 |

FOREIGN PATENT DOCUMENTS

| | | | |
|---|---|---|---|
| 2531156 | 2/1994 | France | 411/501 |
| 58-108714 | 6/1983 | Japan | 335/285 |
| 58-145106 | 8/1983 | Japan | 335/285 |
| 59-18615 | 1/1984 | Japan | 335/285 |
| 59-119804 | 7/1984 | Japan | 335/285 |
| 62-55906 | 3/1987 | Japan | 335/285 |
| 8-78230 | 3/1996 | Japan . | |

*Primary Examiner*—James R. Brittain
*Attorney, Agent, or Firm*—Cooper & Dunham LLP

[57] ABSTRACT

A magnetic snap fastener for releasably connecting two pieces of material. There is a tubular or partially sealed hollow stem with a central opening. The stem fits into a hole in a magnet to connect each of two sections of the fastener.

12 Claims, 8 Drawing Sheets

MAGNETIC SNAP FASTENERS

This is a continuation of application Ser. No. 08/651,522, filed May 22, 1996 now U.S. Pat. No. 5,722,126.

BACKGROUND

1. Field of the Invention

The instant invention relates to magnetic snap fasteners. More particularly, the instant invention relates to a magnetic snap fastener with a first half having a ring-shaped magnet and a second half having a tubular or partially sealed snap alignment means for insertion within the central hole in the ring-shaped magnet.

2. Description of Prior Art

Several patents have issued which show and describe magnetic snap fasteners. U.S. Pat. No. 4,453,294, issued to Tamao Morita, entitled "Engageable Article Using Permanent Magnet", as reexamined and confirmed under Reexamination Certificate B1 4,453,294 (hereinafter "Morita '294") relates to a magnetic closure wherein a solid projection on a first half of the closure is adapted to fit within a hole in a circular magnet attached to the second half of the closure. Additionally, the second half of the closure, to which the circular magnet is attached, is solid in the area beneath the central hole in the circular magnet.

Likewise, U.S. Pat. No. 4,021,891, issued to Tamao Morita, entitled "Magnetic Lock Closure", as reexamined and confirmed under Reexamination Certificate B2 4,021,891 (hereinafter "Morita '891") relates to a magnetic closure wherein a solid projection on a first half of the closure is adapted to fit within a hole in a circular magnet attached to the second half of the closure. Again, the second half of the closure, to which the circular magnet is attached, is solid in the area beneath the central hole in the circular magnet. The Morita '294 and Morita '891 patents essentially describe the same product.

Finally, British Patent Specification No. 1,519,246, published Jul. 26, 1978 (hereinafter "Aoki") discloses a magnetic closure wherein a projection on a first half of the closure is adapted to fit within a hole in a circular magnet attached to the second half of the closure. The projection is specifically described as a sealed extension of the first half of the closure. Again, on the second half of the closure, to which the circular magnet is attached, there is a solid surface in the area beneath the central hole in the circular magnet.

The solid projections of Morita '294 and Morita '891 and the sealed projection of Aoki help to align the first half and the second half of the closures during the closure process. However, these closures have certain disadvantages. They do not permit automated manufacturing such as the use of a light activated alignment means used for the assembly of the component parts. This allows faster assembly rates and reduced costs with good quality. Further, these solid and sealed projections do not permit the use of a quick and efficient coating process, whereby a number of closures are simultaneously exposed to coating while being manipulated on a string or wire passed through a hole that is coaxial with the projection.

SUMMARY OF THE INVENTION

It is therefore an object of the present invention to provide a magnetic snap fastener which can be easily fabricated for sale at a reasonable price.

It is a further object of the present invention to provide a magnetic snap fastener with at least one closure half having tubular alignment means with a hole therethrough that may be used to support the closure half during a coating process. The tubular alignment means of the instant invention not only provides a means to support a closure half while it is being coated, but it also maximizes the magnetic attraction force between a male half and a female half of a snap incorporating such an advantageous coating process support means.

It is a further object of the present invention to provide a magnetic snap fastener with at least one closure half having tubular alignment means with a hole therethrough, the hole being used to allow a light source (such as an infrared light source, for example) to direct a beam of light through the closure half to help align the closure half while it is being attached to a piece of material. The tubular alignment means of the instant invention not only provides a means to permit the passage of light through a closure half, but it also maximizes the magnetic attraction force between a male half and a female half of a snap incorporating such an advantageous light passage feature.

These and other advantages will become apparent from the detailed description accompanying the claims and attached drawing figures.

DETAILED DESCRIPTION OF THE PREFERRED EMBODIMENTS

Figure 1A:
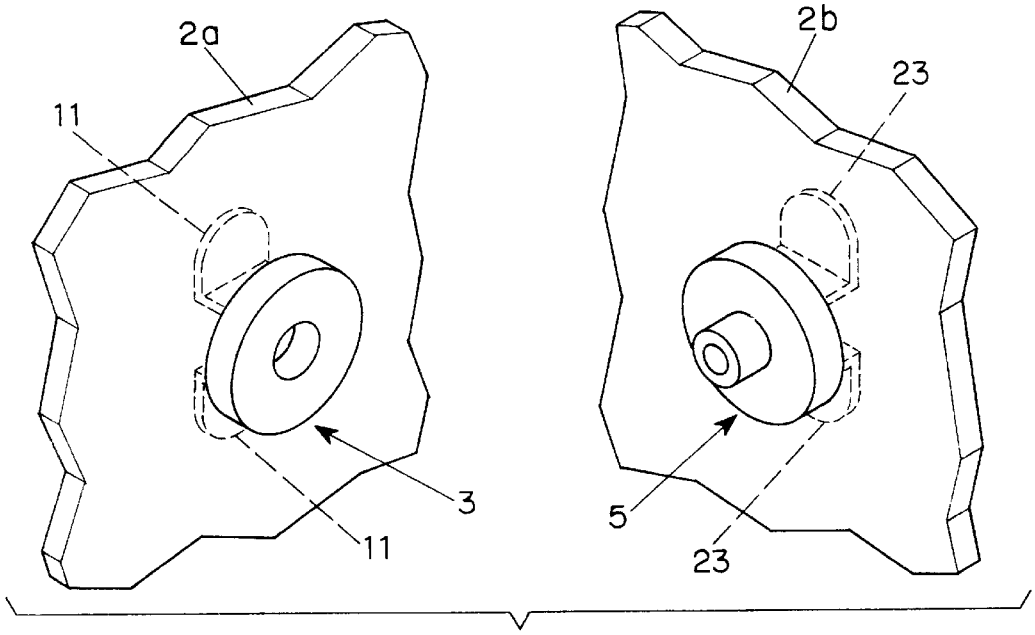
FIG. 1*a* is a perspective view showing a first embodiment of the magnetic snap fastener of the invention as applied to pieces of material and FIG. 1*b* is a cross-sectional view of a first embodiment of the instant invention.
Figure 1B:
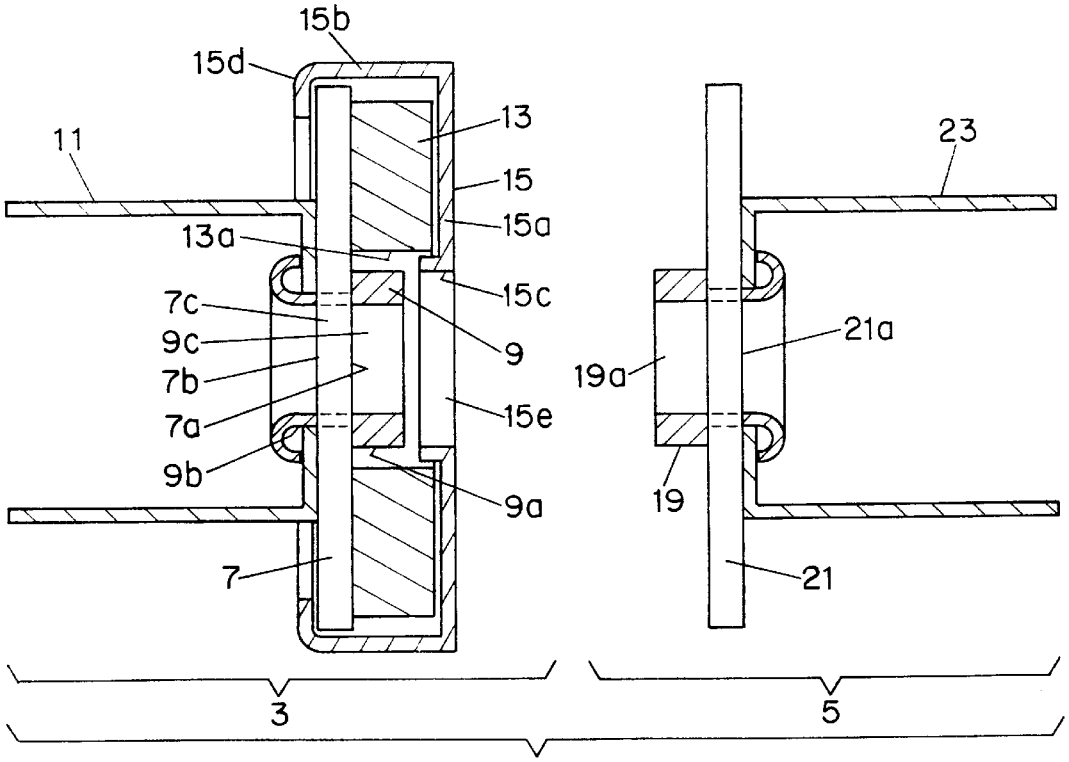

Referring now to FIGS. 1*a* and 1*b*, an apparatus according to a first preferred embodiment of the invention is shown in which the female section 3 and the male section 5 of magnetic snap fastener 1 are separated from one another. Female section 3 and male section 5 are adapted to mate so as to form a complete fastener.

The female section 3 includes a first base washer 7 with first side 7*a*, opposite facing second side 7*b* and central hole 7*c*. Tubular stem 9 is circular in cross-section and has a central hole 9*c*. Tubular stem 9 also has a wide diameter section 9*a* and a narrow diameter section 9*b* and is insertable into the hole 7*c* in base washer 7 from base washer first side 7*a*. The distal end of the narrow diameter section 9*b* is rolled over to affix attachment legs 11 adjacent to the second side 7*b* of base washer 7. Preferably, the legs 11 are not rigidly secured so as to allow them to rotate with respect to base washer 7. This allows coating solutions to reach all surfaces thereby giving greater corrosion protection.

Magnetic ring 13 is held adjacent to first side 7*a* of first base washer 7 by non-magnetic cover 15, which has a top 15*a* and a side wall 15*b*. Flange 15*c* helps contain magnetic ring 13 in place within the cover 15 and continuous flange 15*d* holds the cover in place relative to the first base washer 7. The continuous flange 15*d* holds the cover 15 in place more securely than if discrete prongs or tabs are used. Non-magnetic cover 15 may be made of brass to enhance the appearance of the fastener. Preferably, flange 15*d* is continuous about the periphery of cover 15 so that the cover is not easily removable and lies flat against the piece of material. Magnetic ring 13 is toroidal in shape and has a central hole 13*a* larger than the outside diameter of the wide diameter section 9*a* of tubular stem 9. Since tubular stem 9 and non-magnetic cover 15 have central holes 9*c* and 15*e*, respectively, they are substantially axially aligned with central hole 7*c* of first base washer 7.

Turning now to male section 5 of magnetic snap 1, it is seen that second tubular stem 19 connects second base washer 21 to attachment legs 23 in a manner similar to that used in connection with the female section 3. Here again, second tubular stem 19 has a central hole 19*a* that is substantially axially aligned with central hole 21*a* of second base washer 21. The attachment legs 23 are preferably not rigidly secured so that they may rotate with respect to the second base washer 21. This allows coating solutions to reach all surfaces thereby giving greater corrosion protection.

As is clear from FIGS. 1*a* and 1*b*, second tubular stem 19 is insertable into hole 15*e* of non-magnetic cover 15. Due to the force of the magnetic ring 13, the male section 5 and female section 3 snap together. Legs 11 and 23 may, of course, be attached to two respective pieces of material 2*a* and 2*b*. Thus, the two pieces of material 2*a* and 2*b* are attached when the female section 3 and the male section 5 are snapped together. Moreover, the continuous flange 15*d* of female section 3 contacts the piece of material 2*a* around substantially the entire perimeter of the female section 3, providing a superior cosmetic appearance as compared to the use of discrete prongs or tabs to hold the cover 15 in place, which would raise the bulk of the female section 3 above the piece of material 2*a*.

Figure 2A:
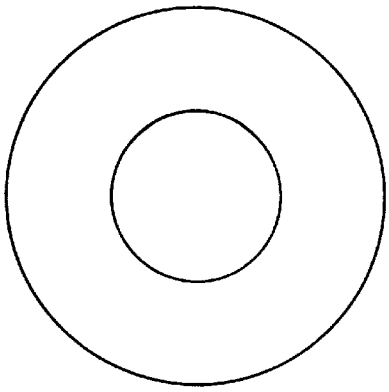
FIGS. 2*a* and 2*b* are a top view and a side cut-away view, respectively, of the magnetic ring of the first embodiment.
Figure 2B:
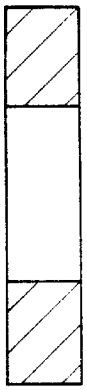
Figure 3A:
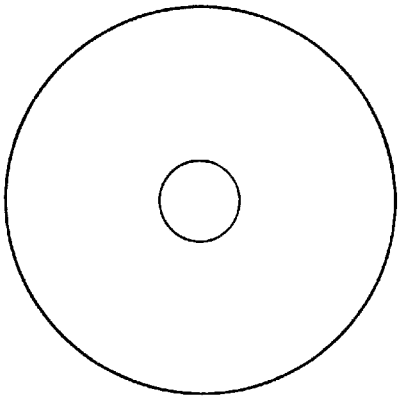
FIGS. 3*a* and 3*b* are a top view and a side cut-away view, respectively, of the first and second base washers of the first embodiment.
Figure 3B:
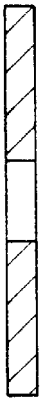
Figure 4A:
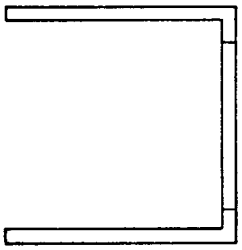
FIGS. 4*a*, 4*b*, and 4*c* are a side view and a plan view, respectively, of the legs of the first embodiment.
Figure 4C:
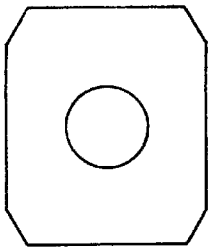
Figure 4B:
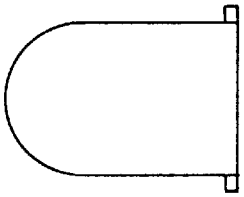
Figure 5A:
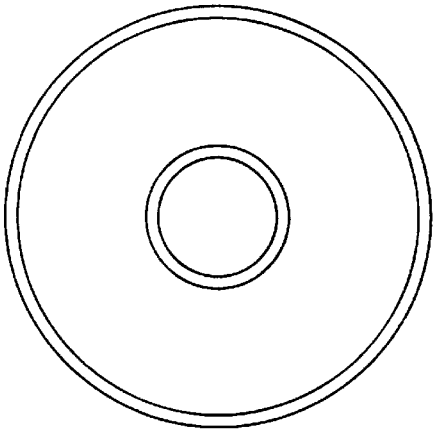
FIGS. 5*a* and 5*b* are a top view and a side cut-away view, respectively, of the non-magnetic cover of the first embodiment.
Figure 5B:
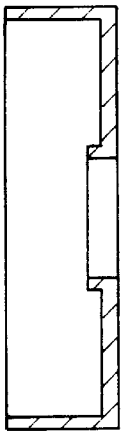
Figure 6A:
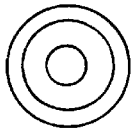
FIGS. 6*a* and 6*b* are a top view and a side cut-away view, respectively, of the tubular stems of the first embodiment.
Figure 6B:
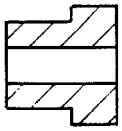

FIGS. 2*a* and 2*b* show a top view and a side cut-away view, respectively, of the magnetic ring 13. FIGS. 3*a* and 3*b* show a top view and a side cut-away view, respectively, of both the first and second base washers 7 and 21. FIGS. 4*a*, 4*b*, and 4*c* show side views and a plan view, respectively, of both the legs 11 and 23. FIGS. 5*a* and 5*b* show a top view and a side cut-away view, respectively, of the non-magnetic cover 15. FIGS. 6*a* and 6*b* show a top view and side cut-away view, respectively, of both the tubular stems 9 and 19. It is a particular feature of this embodiment of the invention that the base washers, legs, and tubular stems are identical on both the female and male sections of the fastener. This reduces the number of different parts needed to make a complete assembly. The axially aligned holes in the components are one distinguishing feature of the invention.

It is important that each of the openings are in axial alignment. Thus, central holes 7*c*, 9*c*, 13*a*, 15*e*, 19*a*, and 21*a* form a straight path. This path should not be too large in diameter. For example, the diameter should be about 0.006 to 0.125 inch.

Figure 7:
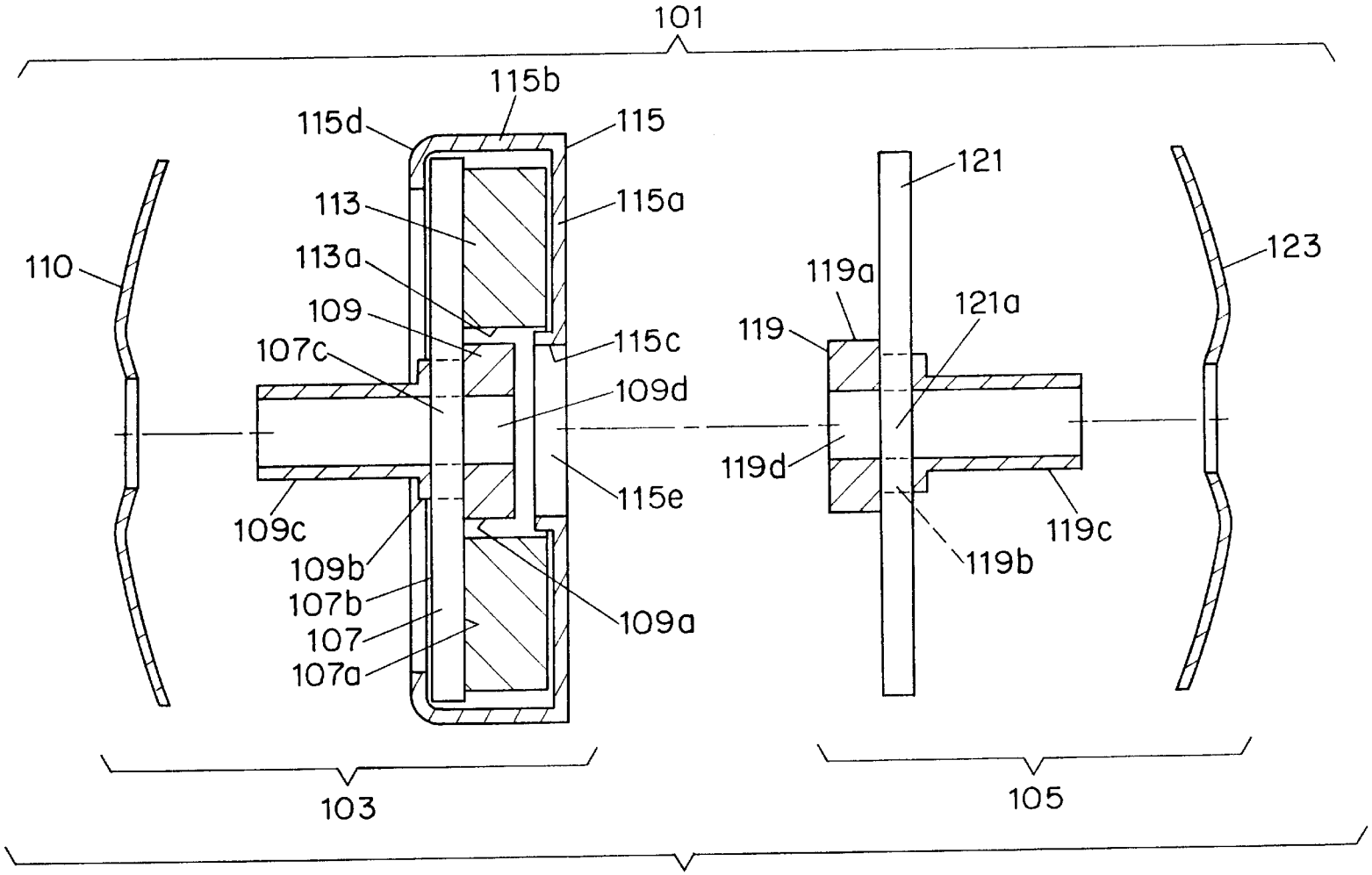
FIG. 7 is a cross-sectional view of a second embodiment of the instant invention.

Referring now to FIG. 7, an apparatus according to a second preferred embodiment of the invention is shown in which the female section 103 and the male section 105 of magnetic snap 101 are separated from one another. Female section 103 and male section 105 are adapted to mate to form a complete snap fastener. Magnetic snap fastener 101 is a rolled rivet type of fastener.

The female section 103 includes a first base washer 107 with first side 107*a*, opposite facing second side 107*b* and central hole 107*c*. Tubular stem 109 is circular in cross-section and has a wide diameter section 109*a*, a medium diameter section 109*b*, a narrow diameter section 109*c*, and a central hole 109*d*. Tubular stem 109 may be inserted into the central hole 107*c* from base washer first side 107*a*. The distal end of the narrow diameter section 109*c* extends outward from the base washer 107 to engage first attachment washer 110, as shown more clearly in FIG. 8 and as discussed below. There are no legs in this embodiment to attach the fastener to pieces of material. Rather, the fasteners are attached by the rolled rivet connectors.

Magnetic ring 113 is held adjacent to first side 107*a* of first base washer 107 by non-magnetic cover 115, which has a top 115*a* and a side wall 115*b*. Flange 115*c* helps contain magnetic ring 113 in place within the cover 115 and continuous flange 115*d* holds the cover in place relative to the first base washer 107. Magnetic ring 113 is toroidal in shape and has a central hole 113*a* larger than the outside diameter of the wide diameter section 109*a* of tubular stem 109. Tubular stem 109 and non-magnetic cover 115 have central holes 109*d* and 115*e*, respectively, which are substantially axially aligned with hole 107*c* of first base washer 107.

Turning now to male section 105 of magnetic snap 101 it is seen that second tubular stem 119, including wide section 119*a*, medium section 119*b*, and narrow section 119*c*, is insertable through hole 121*a* of second base washer 121 in a manner similar to that used in connection with the female section 103. Here again, second tubular stem 119 has a central hole 119*d* that is substantially axially aligned with central hole 121*a* of second base washer 121. Moreover, as described in connection with the female section 103, the distal end of narrow diameter section 119*c* extends outward from the second base washer 121 to engage second attachment washer 123, as shown more clearly in FIG. 8 and as discussed below.

Figure 8:
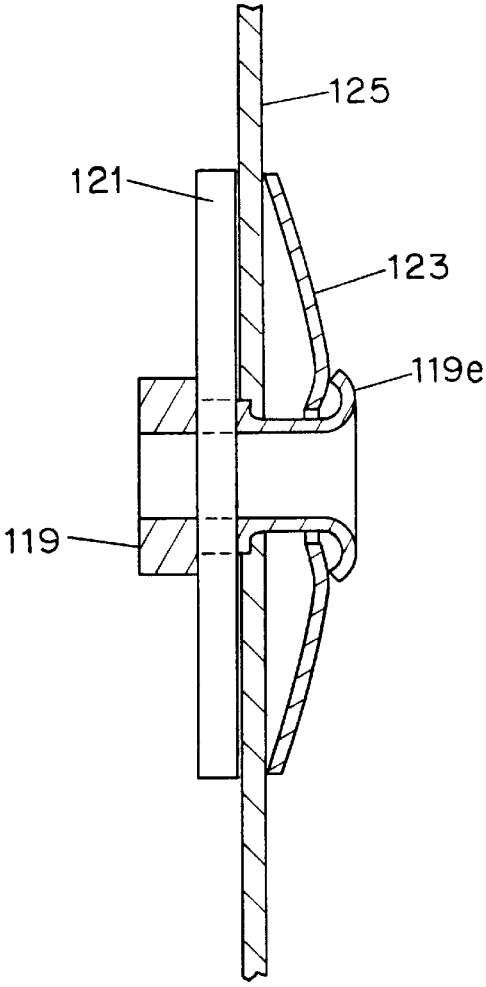
FIG. 8 is a cross-sectional view of the male section of the second embodiment attached to a piece of material.

FIG. 8 shows male section 105 attached to a piece of material 125 held between second base washer 121 and second attachment washer 123. As seen in FIG. 8, tubular stem 119 has section 119*e* rolled over to hold base washer 123 in place. Female section 103 is attached to a piece of material in a similar manner. Thus, the mating of female section 103 and male section 105 results in attachment of the two pieces of material.

Figure 9A:
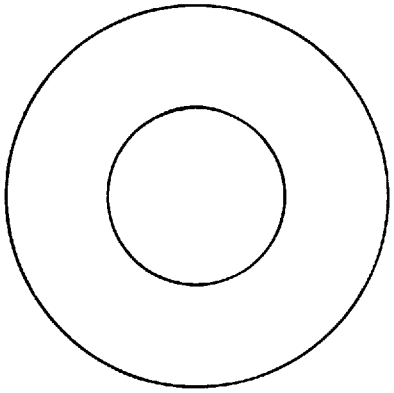
FIGS. 9*a* and 9*b* are a top view and a side cut-away view, respectively, of the magnetic ring of the second embodiment.
Figure 9B:
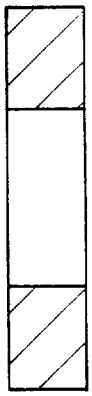
Figure 10A:
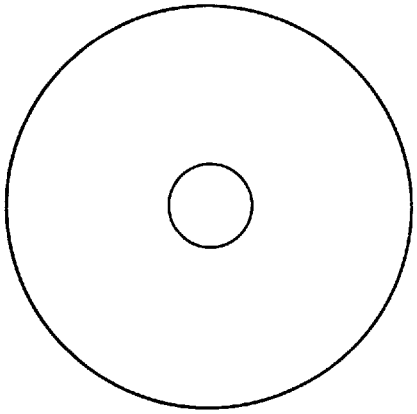
FIGS. 10*a* and 10*b* are a top view and a side cut-away view, respectively, of the first and second base washers of the second embodiment.
Figure 10B:
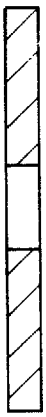
Figure 11A:
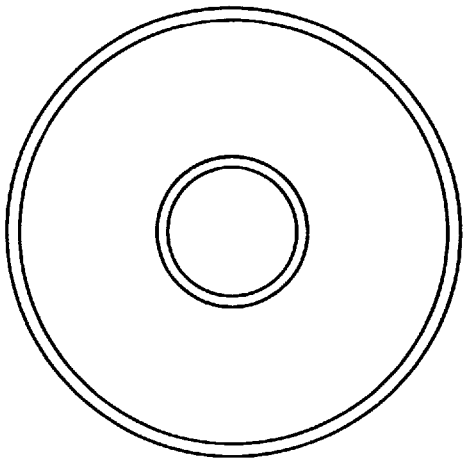
FIGS. 11*a* and 11*b* are a top view and a side cut-away view, respectively, of the non-magnetic cover of the second embodiment.
Figure 11B:
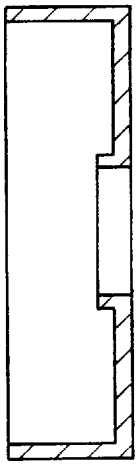
Figure 12A:
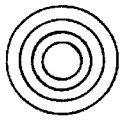
FIGS. 12*a* and 12*b* are a top view and a side cut-away view, respectively, of the tubular stems of the second embodiment.
Figure 12B:
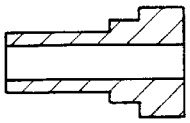

FIGS. 9*a* and 9*b* show a top view and a side cut-away view, respectively, of the magnetic ring 113, FIGS. 10*a* and 10*b* show a top view and a side cut-away view, respectively, of both the first and second base washers 107 and 121. FIGS. 11*a* and 11*b* show a top view and side cut-away view, respectively, of the non-magnetic cover 115. FIGS. 12*a* and 12*b* show a top view and a side cut-away view, respectively, of both the tubular stems 109 and 119. Once again, several of these components are identical so as to provide for easy assembly and to reduce the cost of the finished product.

Figure 13:
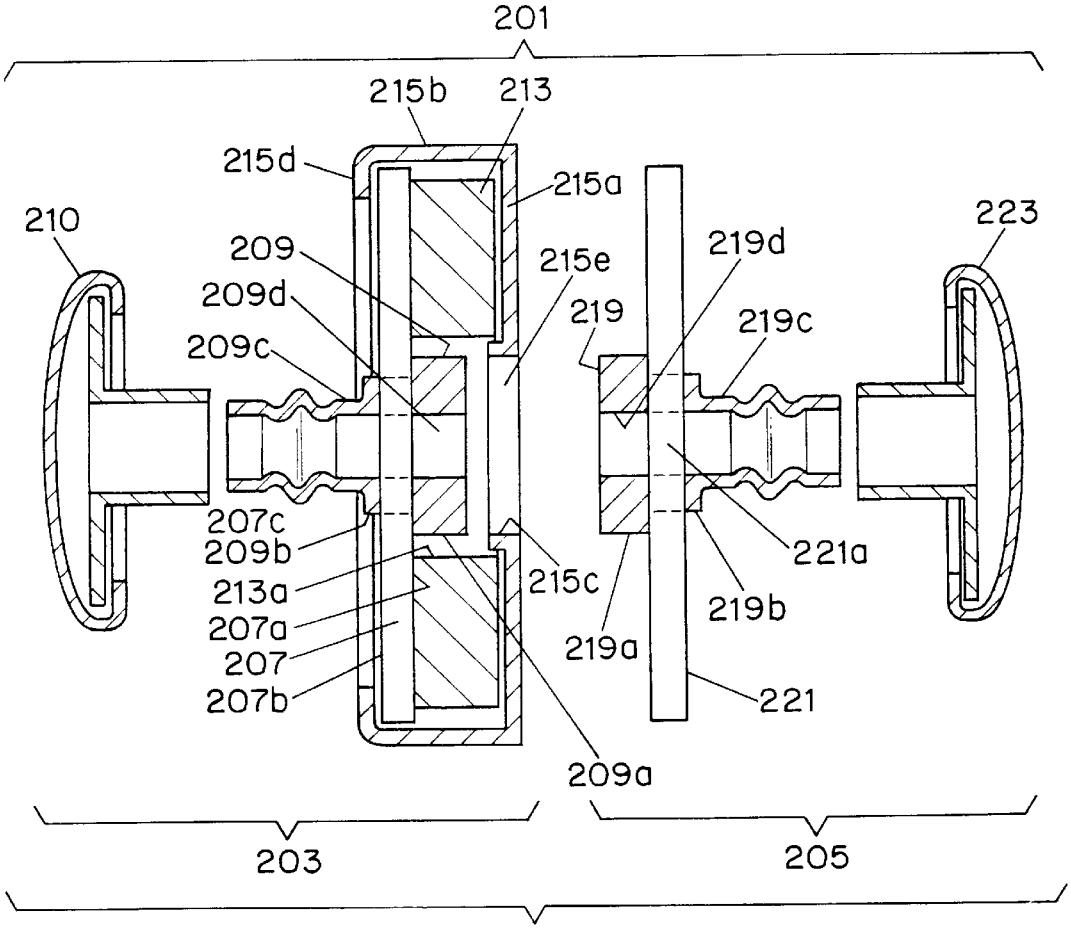
FIG. 13 is a cross-sectional view of a third embodiment of the instant invention.

Referring now to FIG. 13, an apparatus according to a third preferred embodiment of the invention is shown in which the female section 203 and the male section 205 of magnetic snap 201 are separated from one another. Female section 203 and male section 205 are designed to unite to form a magnetic snap fastener of the Kwik-rivet style.

The female section 201 includes a first base washer 207 with first side 207*a*, oppositely facing second side 207*b*, and central hole 207*c*. Tubular stem 209, which is circular in cross-section and which has a wide diameter section 209*a*, a medium diameter section 209*b*, and a narrow diameter section 209*c*, is insertable into the central hole 207*c* from base washer first side 207*a*. The distal end of the narrow diameter section 209*c* extends outward from the base washer 207 to engage first rivet cap 210, as shown more clearly in FIG. 14 and as discussed below. There are no legs in this embodiment to attach the fastener to the pieces of material. Rather, the fasteners are attached by the Kwik-rivet connectors. The rivet cap 210 may have a decorative surface or embossing.

Magnetic ring 213 is held adjacent to first side 207*a* of first base washer 207 by non-magnetic cover 215, which has a top 215*a* and a side wall 215*b*. Flange 215*c* helps contain magnetic ring 213 in place within the cover 215 and continuous flange 215*d* holds the cover in place relative to the first base washer 207. Magnetic ring 213 is toroidal in shape and has a central hole 213*a* larger than the outside diameter of the wide diameter section 209*a* of tubular stem 209. Tubular stem 209 and non-magnetic cover 215 have central holes 209*c* and 215*e*, respectively, which are substantially axially aligned with hole 207*c* of first base washer 207.

Turning now to male section 205 of magnetic snap 201, it is seen that second tubular stem 219, including wide section 219*a*, medium section 219*b*, and narrow section 219*c*, is insertable through hole 221*a* of second base washer 221 in a manner similar to that used in connection with the female section 203. Here again, second tubular stem 219 has a central hole 219*d* that is substantially axially aligned with central hole 221*a* of second base washer 221. Moreover, as described in connection with the female section 203, the distal end of narrow diameter section 219*c* extends outward from the base washer 207 to engage second rivet cap 223, as shown more clearly in FIG. 14 and as discussed below.

Figure 14:
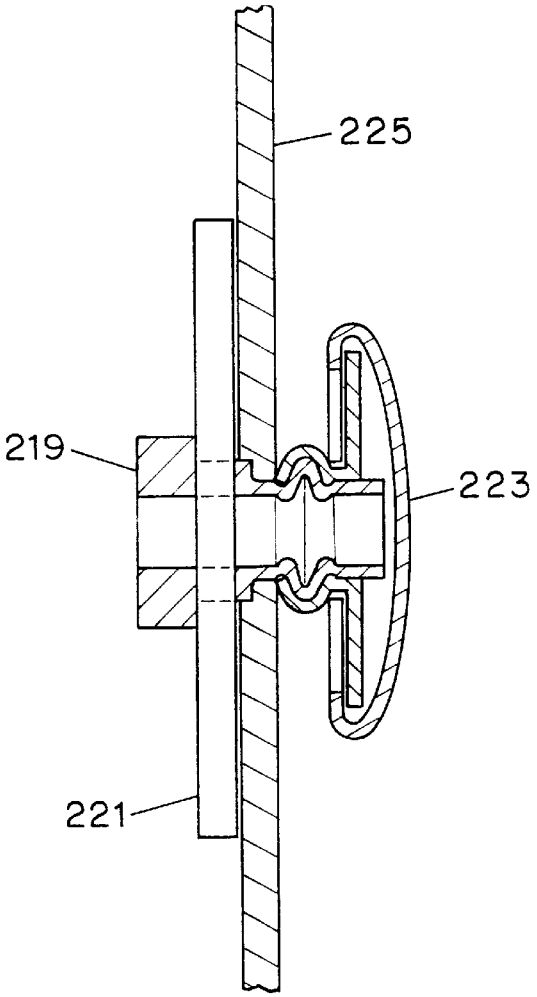
FIG. 14 is a cross-sectional view of the male section of the third embodiment attached to a piece of material.

FIG. 14 shows male section 205 attached to a piece of material 225 held between second base washer 221 and second rivet cap 223. As seen in FIGS. 13 and 14, tubular stem 219 has a collapsible bump that is deformed by attachment of the second rivet cap 223 to cause the distal end of the tubular stem 219 to lock to the inside of the second rivet cap 223 to hold material 225. Female section 203 is attached to a piece of material in a similar manner.

Figure 15A:
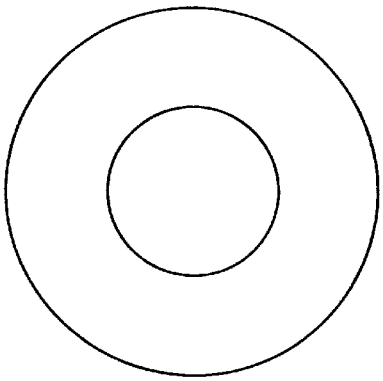
FIGS. 15*a* and 15*b* are a top view and a side cut-away view, respectively, of the magnetic ring of the third embodiment.
Figure 15B:
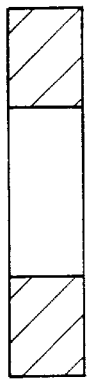
Figure 16A:
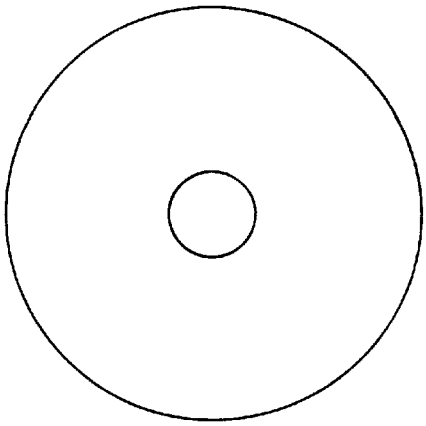
FIGS. 16*a* and 16*b* are a top view and a side cut-away view, respectively, of the first and second base washers of the third embodiment.
Figure 16B:
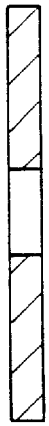
Figure 17A:
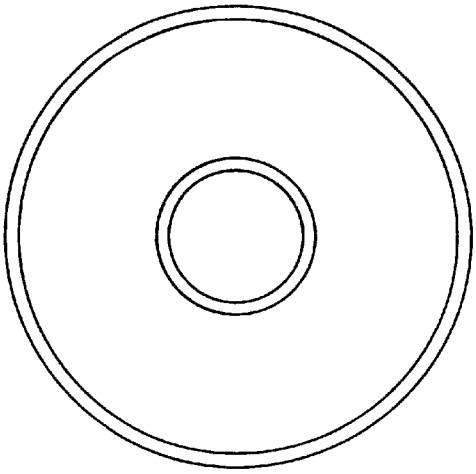
FIGS. 17*a* and 17*b* are a top view and a side cut-away view, respectively, of the non-magnetic cover of the third embodiment.
Figure 17B:
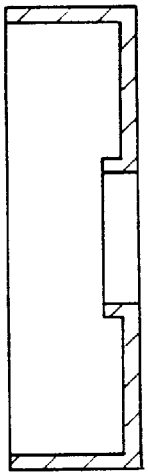
Figure 18A:
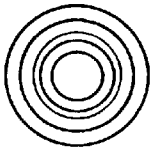
FIGS. 18*a*, and 18*b* are a top view and a side cut-away view, respectively, of the tubular stems of the third embodiment.
Figure 18B:
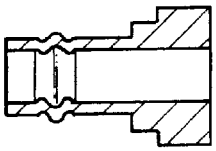

FIGS. 15*a* and 15*b* show a top view and a side cut-away view, respectively, of the magnetic ring 213. FIGS. 16*a* and 16*b* show a top view and a side cut-away view, respectively, of both the first and second base washers 207 and 221. FIGS. 17*a* and 17*b* show a top view and a side cut-away view, respectively, of the non-magnetic cover 215. FIGS. 18*a* and 18*b* show a top view and a side cut-away view, respectively, of both the tubular stems 209 and 219. Several of these components are identical for the reasons previously discussed.

The invention has practical utility in the fastening of pieces of material such as leather or simulated leather, for example, in the manufacture of handbags, wallets, backpacks, and the like.

The improved fasteners of the invention are easily finished such as by coating processes. Because there is a hole through each nonsolid male and female section, the closures may be threaded on a wire and rapidly processed. The fasteners, because they have a hole therethrough, may be easily assembled using automatic positioning devices. For example, an infrared light source such as a laser alignment beam may be used to direct light through the holes to align the closures when they are being assembled in the manufacturing process, improving the quality of the parts, speeding assembly, and reducing cost. The axially aligned central holes do not detract from the magnetic attractive force provided by the magnetic ring.

Although the present invention is described by reference to particular embodiments thereof, many changes and modifications of the invention may become apparent to those skilled in the art without departing from the spirit and scope of the invention, which is only limited by the appended claims. For example, the tubular stems may be replaced by hollow stems that are open at one end, that is, they are partially hollow but not solid. Therefore, the embodiments shown and described are only illustrative, not restrictive.

What is claimed is:

1. A magnetic snap fastener for releasably connecting a first surface and a second surface, comprising:

(a) a female section, having a first base washer defining a first hole substantially in the center of the first base washer;

a magnetic ring defining a second hole substantially in the center of the magnetic ring;

a non-magnetic cover plate defining a third hole substantially in the center of the cover plate and having a continuous peripheral flange, the cover plate being mounted to the first base washer by the continuous peripheral flange whereby the magnetic ring is held between the first base washer and the cover plate and whereby the first, second, and third holes are substantially axially aligned;

a first tubular stem with a fourth hole therethrough and substantially in the center thereof, the first tubular stem extending through the first and second holes, whereby the first, second, third, and fourth holes are substantially axially aligned; and first attachment means affixed to the first base washer by the first tubular stem and adapted for attachment to the first surface;

(b) a male section, having a second base washer defining a fifth hole substantially in the center of the second base washer;

a second tubular stem with a sixth hole therethrough and substantially in the center thereof, the second tubular stem extending through the fifth hole, whereby the fifth and sixth holes are substantially axially aligned; and second attachment means affixed to the second base washer by the second tubular stem and adapted for attachment to the second surface;

(c) whereby insertion of the second tubular stem into at least the second and third holes creates a magnetic force which releasably connects the female and male sections and hence the first and second surfaces attached to the first and second attachment means.

2. The magnetic snap fastener of claim 1, wherein the first attachment means comprises a first rivet cap connectible to a collapsible section of the first tubular stem, whereby the first surface is held between the first rivet cap and the first base washer, and the second attachment means comprises a second rivet cap connectible to a collapsible section of the second tubular stem, whereby the second surface is held between the second rivet cap and the second base washer.

3. A female section of a magnetic snap fastener for releasably connecting a first surface to which the female section of the magnetic snap fastener is attached and a second surface to which a male section of the magnetic snap fastener is attached, comprising:

a base washer defining a first hole substantially in the center of the base washer;

a magnetic ring defining a second hole substantially in the center of the magnetic ring;

a non-magnetic cover plate defining a third hole substantially in the center of the cover plate and having a continuous peripheral flange, the cover plate being mounted to the base washer by the continuous peripheral flange whereby the magnetic ring is held between the base washer and the cover plate and whereby the first, second, and third holes are substantially axially aligned;

a tubular stem with a fourth hole therethrough and substantially in the center thereof, the first tubular stem extending through the first and second holes, whereby the first, second, third, and fourth holes are substantially axially aligned; and attachment means affixed to the first base washer by the tubular stem and adapted for attachment to the first surface;

whereby insertion of the male section of the magnetic snap fastener into at least the second and third holes creates a magnetic force which releasably connects the female and male sections and hence the first surface attached to the attachment means and the second surface attached to the male section of the magnetic snap fastener.

4. The female section of the magnetic snap fastener of claim 3, wherein the attachment means comprises a pair of legs.

5. The female section of the magnetic snap fastener of claim 4, wherein the pair of legs is mounted to the base washer by the tubular stem.

6. The female section of the magnetic snap fastener of claim 3, wherein the attachment means comprises an attachment washer connectible to the tubular stem, whereby the first surface is held between the attachment washer and the base washer.

7. The female section of the magnetic snap fastener of claim 3, wherein the attachment means comprises a rivet cap connectible to a collapsible section of the tubular stem, whereby the first surface is held between the rivet cap and the base washer.

8. A male section of a magnetic snap fastener for releasably connecting a first surface to which the male section of the magnetic snap fastener is attached and a second surface to which a female section of the magnetic snap fastener is attached, comprising:

a base washer defining a first hole substantially in the center of the base washer;

a tubular stem with a second hole therethrough and substantially in the center thereof, the tubular stem extending through the first hole, whereby the first and second holes are substantially axially aligned; and attachment means non-rigidly connected to the base washer by the tubular stem so that the attachment means may rotate with respect to the base washer the attachment means being adapted for attachment to the first surface;

whereby bringing the tubular stem into contact with the female section of the magnetic snap fastener creates a magnetic force which releasably connects the male and female sections and hence the first surface attached to the attachment means and the second surface attached to the female section of the magnetic snap fastener.

9. The male section of the magnetic snap fastener of claim 8, wherein the attachment means comprises a pair of legs non-rigidly connected to the base washer by the tubular stem.

10. The male section of the magnetic snap fastener of claim 9, wherein the pair of legs is mounted to the base washer by the tubular stem.

11. The male section of the magnetic snap fastener of claim 8, wherein the attachment means comprises an attachment washer connectible to the tubular stem, whereby the first surface is held between the attachment washer and the base washer.

12. The male section of the magnetic snap fastener of claim 8, wherein the attachment means comprises a rivet cap connectible to a collapsible section of the tubular stem, whereby the first surface is held between the rivet cap and the base washer.

* * * * *

UNITED STATES PATENT AND TRADEMARK OFFICE

CERTIFICATE OF CORRECTION

PATENT NO. : 5,933,926

DATED : August 10, 1999

INVENTOR(S) : Howard J. REITER

It is certified that error appears in the above-identified patent and that said Letters Patent is hereby corrected as shown below:

On the Title Page:

The address of the Inventor is incorrect. The address should read:
Howard J. Reiter
P.O. Box 895
Orange, Connecticut 06477

On the Title Page, insert Item [73] Assignee: Romag Fasteners Inc.
Orange, Connecticut 06477

Signed and Sealed this

Third Day of April, 2001

*Attest:*

Nicholas P. Godici

NICHOLAS P. GODICI

*Attesting Officer*

*Acting Director of the United States Patent and Trademark Office*